US008803747B2

(12) United States Patent
Yashima

(10) Patent No.: US 8,803,747 B2
(45) Date of Patent: Aug. 12, 2014

(54) ANTENNA COMPONENT AND ANTENNA DEVICE

(75) Inventor: Tetsushi Yashima, Isesaki (JP)

(73) Assignee: Tokyo Parts Industrial Co., Ltd., Gunma-ken (JP)

( * ) Notice: Subject to any disclaimer, the term of this patent is extended or adjusted under 35 U.S.C. 154(b) by 747 days.

(21) Appl. No.: 12/924,768

(22) Filed: Oct. 5, 2010

(65) Prior Publication Data

US 2011/0122046 A1 May 26, 2011

(30) Foreign Application Priority Data

Nov. 24, 2009 (JP) ..... 2009-266071

(51) Int. Cl.
*H01Q 1/32* (2006.01)

(52) U.S. Cl.
USPC ..... 343/713; 343/711; 343/787; 343/788

(58) Field of Classification Search
USPC ..... 343/907, 711, 713, 787, 788
See application file for complete search history.

(56) References Cited

U.S. PATENT DOCUMENTS 7,192,285 B2 * 3/2007 Makino et al. ..... 439/34
7,598,915 B2 * 10/2009 Ieda et al. ..... 343/713

FOREIGN PATENT DOCUMENTS

JP 2005-282060 10/2005
JP 2006-197503 7/2006

* cited by examiner

*Primary Examiner* — Jacob Y Choi
*Assistant Examiner* — Kyana R McCain
(74) *Attorney, Agent, or Firm* — Jordan and Hamburg LLP

(57) ABSTRACT

Two harness engagement grooves are provided at each end in the longitudinal direction of a rod-shaped antenna component, on one side thereof, and midway in the longitudinal direction, on one side thereof, a uniting groove is provided, having a width, which is smaller than the outermost width of the two harness engagement grooves.

12 Claims, 6 Drawing Sheets

ANTENNA COMPONENT AND ANTENNA DEVICE

BACKGROUND OF THE INVENTION

The present invention relates to an antenna component, and to an antenna device comprising the antenna component and an electronic component such as a switch.

Conventionally, keyless entry systems are known wherein an antenna component and an electronic component such as a request switch or a capacitive sensor are built into the handle grip of an outside door handle device.

For example, in the outside door handle device described in JP-2005-282060-A, as shown in FIG. 5, a housing member 110 is provided, which is made of resin, and a recess 112 in this housing member 110 is covered by a covering member 118, which is made of resin.

A request switch 114 for locking and unlocking the door of the vehicle, an antenna component 116 for detecting the presence of the vehicle door handle user and the like are housed in the recess 112.

Furthermore, a harness 114*a* is connected to a request switch 114, and a harness 116*a* is connected to an antenna component 116.

Then, as shown in FIG. 6, protuberances 116*b* are provided on one side of the antenna component 116, in the lengthwise direction, so as to form a guide groove 116*c*, between the protuberances 116*b*, in the lengthwise direction. The harness 114*a* of the request switch 114 is guided at the interior of the guide groove 116*c* of the antenna component 116.

SUMMARY OF THE INVENTION

With the device wherein the guide groove 116*c* is provided on the antenna component 116, as shown in FIG. 6, because the antenna component 116 and the request switch 114 are not assembled in a united manner, assembly into the outside door handle device is difficult, and thus the work efficiency is poor.

Here, in order to unite the antenna component 116 and the request switch 114 in advance, it is conceivable that, with the harness 114*a* of the request switch 114 guided in the guide groove 116*c* of the antenna component 116, the harness 114*a* is fixed in place on the antenna component 116 with adhesive tape or a special flexible ring or the like.

However, it is certainly not labor efficient to fix this in place with adhesive tape or the like and, due to the risk of the adhesive tape peeling off, particularly in high temperature/high humidity environments, there are also problems in terms of reliability.

A first object of the present invention is to provide an antenna component that can overcome the problems found in the prior art as described above, and which can simply and reliably be united with an electronic component, such as a switch, having a harness, without the use of special members.

A second object of the present invention is to provide an antenna device wherein an antenna component and an electronic component, such as a switch, are united.

The antenna component of the present invention, which is directed at achieving the aforementioned objects, is a rod-shaped antenna component, which is characterized by comprising, at each end in the longitudinal direction, on one side thereof, at least two harness engagement grooves, and by comprising, midway in the longitudinal direction, on one side thereof, a uniting groove having a width that is smaller than the outermost width of the plurality of harness engagement grooves.

In the antenna component of the present invention, it is desirable to separate the harness engagement groove and the uniting groove.

Furthermore, the antenna device of the present invention which is directed at achieving the aforementioned objects is an antenna device comprising the antenna component of the present invention and an electronic component to which at least two harnesses are connected, which is characterized in that the harnesses of the electrical component are fitted into the harness engagement grooves at both ends of the antenna component, and are inlayed in the uniting groove.

Furthermore, in the antenna device of the present invention, it is preferable that the electronic component is a request switch.

By virtue of the antenna component of the present invention, it is possible to effectively retain and fasten a harness of an electronic component, and to realize an antenna device wherein the antenna component and an electrical component such as a request switch are united, with which the work efficiency is good.

DETAILED DESCRIPTION OF THE PREFERRED EMBODIMENTS

Hereafter, modes of embodiment of the present invention are illustratively described with reference to the drawings.

First Mode of Embodiment

Figure 1:
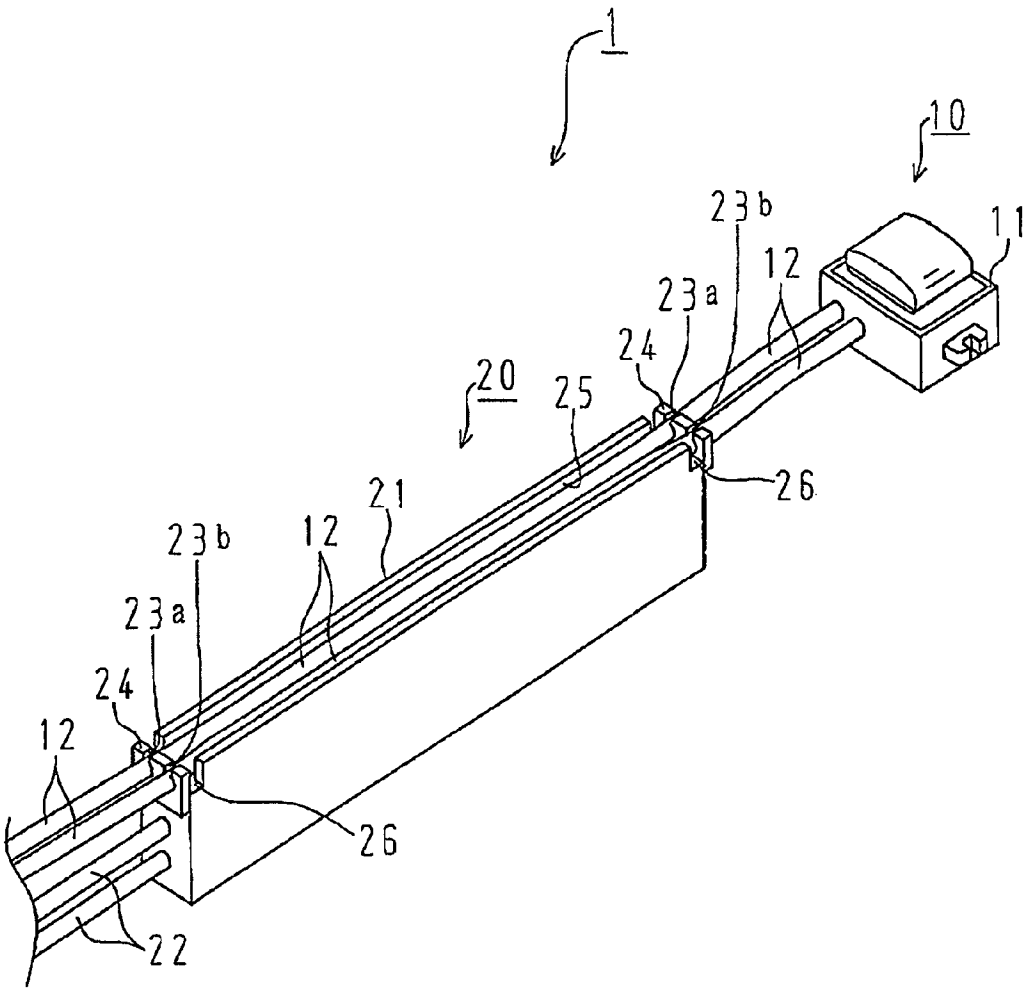
FIG. 1 is a perspective view illustrating essential elements of an antenna device according to a first mode of embodiment of the present invention.

FIG. 1 is a perspective view showing essential elements of an antenna device according to a first mode of embodiment of the present invention.

This antenna device 1 comprises a switch 10 and a rod-shaped antenna component 20.

Figure 2:
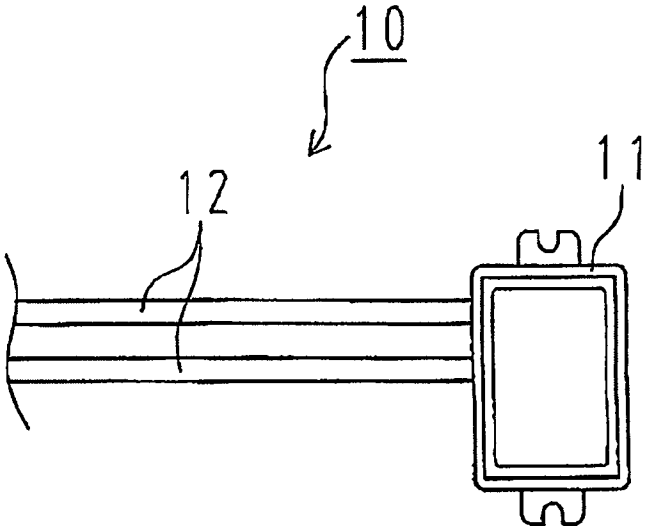
FIG. 2 is a plan view illustrating essential components of a switch according to the first mode of embodiment of the present invention.

The switch 10 is a request switch for locking and unlocking the door of a vehicle, which is not shown in the drawing. As shown in FIG. 2, two harnesses 12 are connected to the switch body 11.

The antenna component 20 serves to detect the presence of a vehicle door handle user. Two harnesses 22 are connected to an antenna body 21, wherein the outer surface of a strip-shaped magnetic core 21*a*, on which a coil 21*b* is wound, is covered with resin by way of injection molding.

Figure 3:
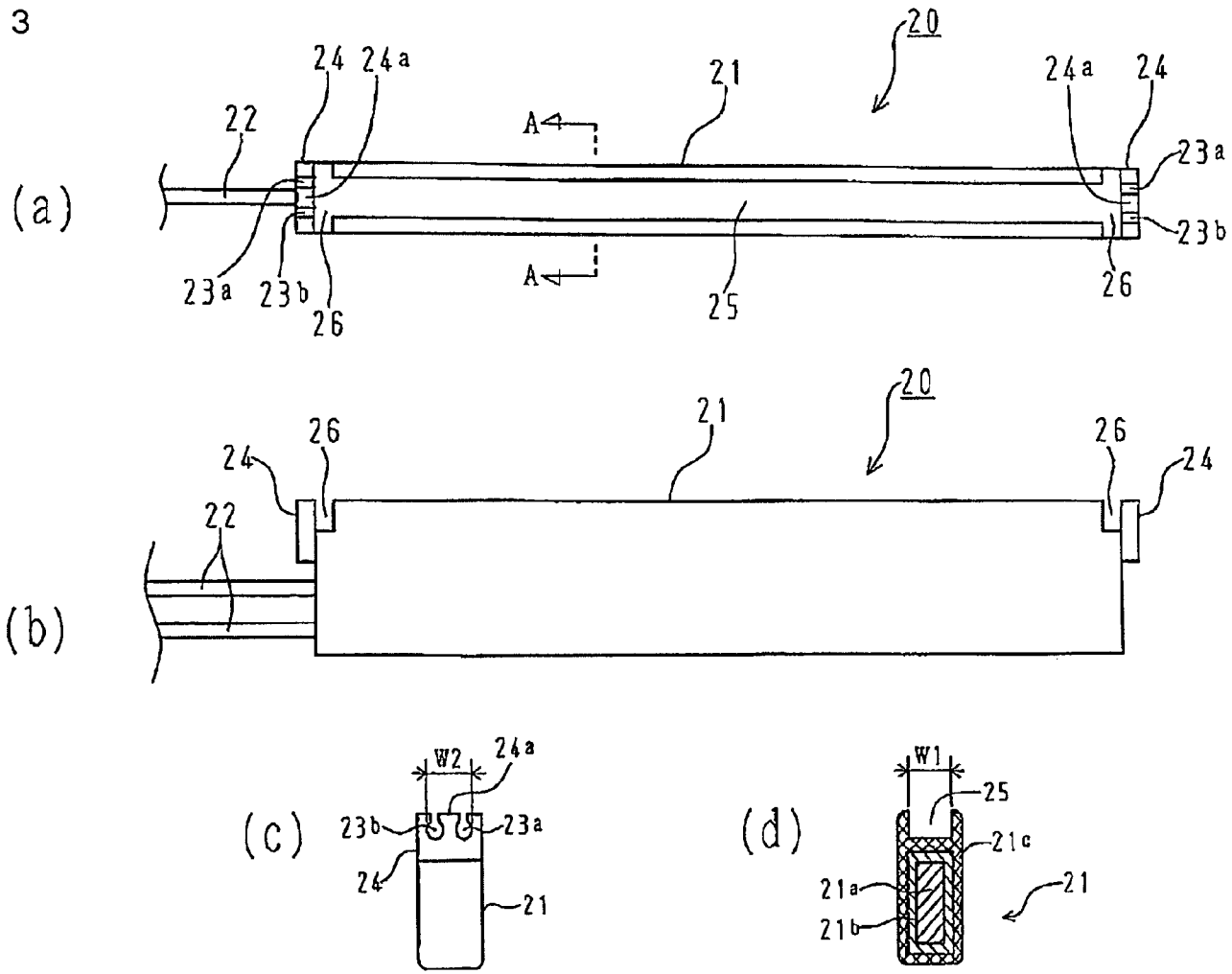
FIG. 3 is a view showing essential elements of an antenna component according to the first mode of embodiment of the present invention, wherein (a) is a plan view, (b) is a front view, (c) is a side view, and (d) is a sectional view according to line A-A in (a).

As shown in FIG. 3, an engagement part 24 is formed, which comprises two harness engagement grooves 23*a*, 23*b*, which are separated by a dividing wall 24*a*, at both ends of the resin cover 21*c* of the antenna body 21, in the longitudinal direction, on one side thereof, and a uniting groove 25 is formed midway, in the longitudinal direction, on one side thereof.

A separating groove 26 is formed between the engagement part 24 and the uniting groove 25, which separates the engagement part 24 and the uniting groove 25.

The harness engagement grooves 23*a*, 23*b* are both formed with a sectional Ω shape, the entrances thereof being narrow and the interiors being wide. The harness engagement grooves 23*a*, 23*b* are large enough to reliably engage each of the harnesses 12 of the switch 10.

The uniting groove 25 is formed with a cross-section that is roughly ovoid or rectangular, and serves to receive and hold the two harnesses 12 of the switch 10 together. The width W1 of this uniting groove 25 is smaller than the outermost width W2 of the two harness engagement grooves 23*a*, 23*b*, and is slightly narrower than twice the diameter of the harness 12.

As shown in FIG. 1, the two harnesses 12 of the switch 10 are each separately fitted into the harness engagement grooves 23*a*, 23*b* at the two ends of the antenna component 20, and are inlaid in, and held together by, the uniting groove 25. The two harnesses 12 of the switch 10 extend in the same direction as the two harnesses 22 of the antenna component 20. Consequently, the switch 10 and the antenna component 20 are united so as to constitute an antenna device 1.

With the antenna device 1 of this embodiment, because a plurality of harness engagement grooves 23*a*, 23*b* are separately provided for each harness of the switch 10, at both ends in the longitudinal direction of the antenna component 20, all of the harnesses of the switch 10 can easily and reliably be retained and fastened.

Conversely, if for example, the harness engagement grooves 23*a*, 23*b* were formed along the entire length of the antenna component, it would be difficult to fit the harnesses into the harness engagement grooves, which would negatively impact work efficiency. Furthermore, for example, with a configuration in which, rather than providing a harness engagement groove for each harness, a plurality of harnesses were received by one large Ω-shaped harness engagement groove, the harnesses could easily become twisted, and the harnesses would be likely to come out or to break.

Furthermore, with the antenna device 1 of the present embodiment, the uniting groove 25 is provided between the two engagement parts 24 having the harness engagement grooves 23*a*, 23*b*, which is to say, midway in the longitudinal direction of the antenna component 20. Accordingly, the two harnesses of the switch 10 can be more reliably retained by receiving and holding them together in this uniting groove 25. Furthermore, when the antenna device 1 is assembled in a vehicle door handle, there is no risk of the harnesses 12 of the switch 10 being caught on other parts.

As opposed to this, if a uniting groove 25 were not provided, when the antenna device 1 was assembled in a vehicle door handle, the harnesses between the harness engagement grooves at each end thereof would be likely to get caught on other parts, which would lead to broken harnesses or cause problems in the vehicle door handle.

Moreover, with the antenna device 1 of the present embodiment, the engagement part 24 and the uniting groove 25 are separated by a separating groove 26, whereby the harnesses can be retained and fastened without applying undue force to the harnesses 12 of the switch 10.

In other words, because the dividing wall 24*a* is present between the harness engagement groove 23*a* and the harness engagement groove 23*b*, the outermost width W2 of the harness engagement grooves 23*a*, 23*b* is more than twice as wide as the diameter of the harness 12, while the width W1 of the uniting groove 25 is slightly narrower than twice the diameter of the harness 12, in order to prevent the two harnesses 12 from coming out.

Consequently, while it is necessary to draw the two harnesses 12 towards each other so that the two harnesses 12 that are fitted into the harness engagement grooves 23*a*, 23*b* can be received in the uniting groove 25, by providing the separating groove 26 having a predetermined dimension in the lengthwise direction of the antenna component, it is possible to smoothly draw these two harnesses 12 towards each other in the region of the separating groove 26. In other words, it is possible for the harnesses 12 to be received in the uniting groove 25 without applying undue force to the harnesses 12, which are fitted in the harness engagement grooves 23*a*, 23*b*, and thus it is possible to prevent breakage of the harnesses.

Furthermore, because the switch 10 and the antenna component 20 are united, when the antenna device 1 is assembled in the vehicle door handle, it is not necessary to position the switch 10 and the antenna component 20 relative to each other, which allows for more efficient work.

Second Mode of Embodiment

Figure 4:
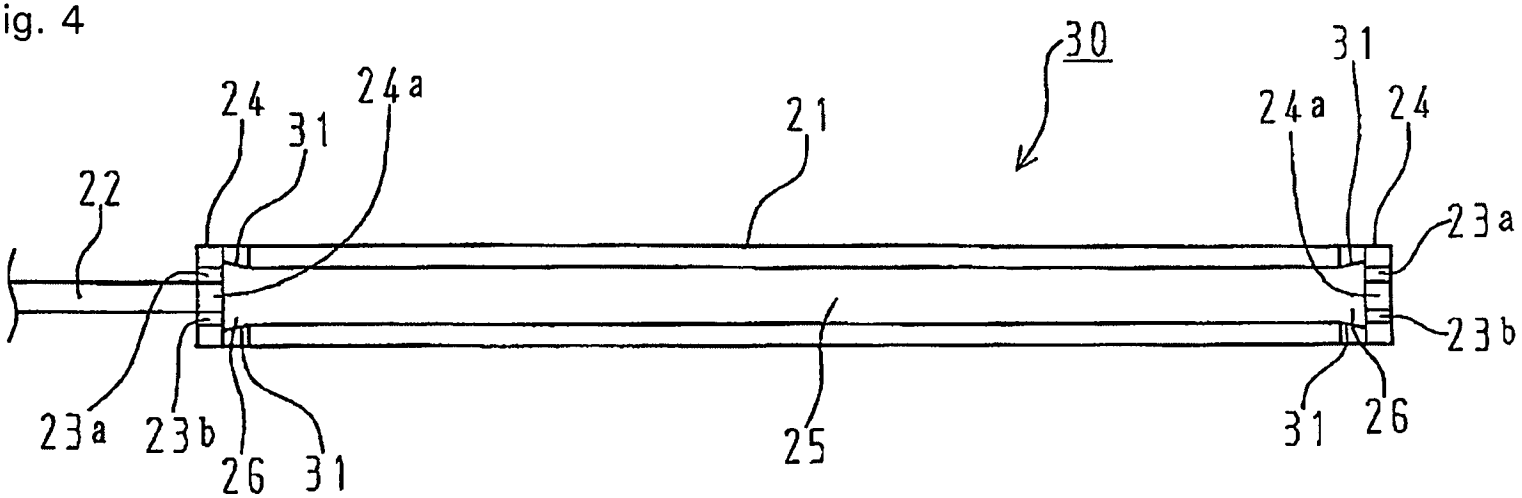
FIG. 4 is a plan view showing essential components of an antenna component according to a second mode of embodiment of the present invention.
Figure 5:
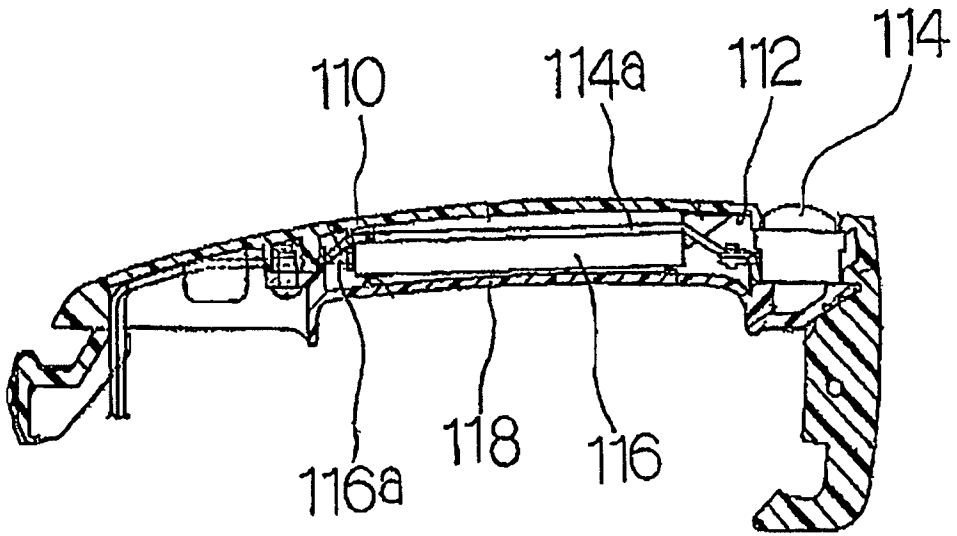
FIG. 5 is a sectional view of a conventional outside door handle device.
Figure 6:
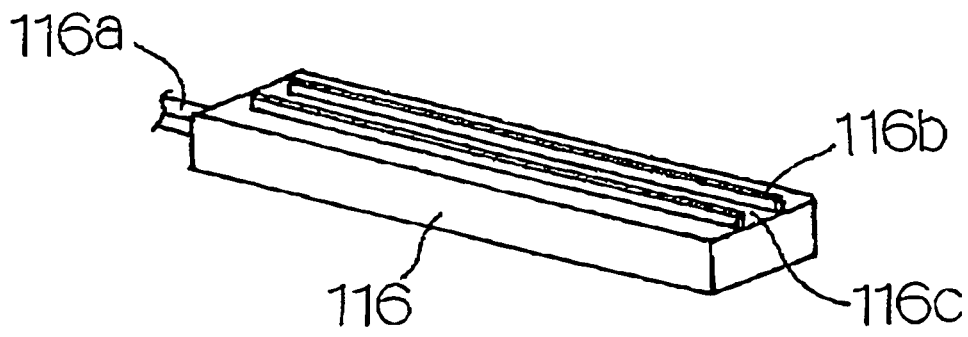
FIG. 6 is a perspective view of a conventional antenna component.

FIG. 4 is a plan view showing essential components of an antenna component according to a second mode of embodiment of the present invention. The difference between the antenna component in this embodiment and the antenna component according to the first mode of embodiment is that an inclined wall 31 is provided, which is joined with the engaging part 24 in the region of the separating groove 26.

As shown in FIG. 4, as with the antenna component 20 according to the first mode of embodiment, the antenna component 30 in this embodiment is such that engagement parts 24 are formed at both ends in the longitudinal direction, on one side thereof, which each have two harness engagement grooves 23*a*, 23*b*, and a uniting groove 25 is formed midway in the longitudinal direction, on one side thereof.

Furthermore, separating grooves 26 are formed between the engagement parts 24, in which the harness engagement grooves 23*a*, 23*b* are formed, and the uniting groove 25. At both sides of these separating grooves 26, inclined walls 31 are formed, which are joined with the engagement parts 24.

By forming these inclined walls 31, the widths of the separating grooves 26 are the same as the width W1 of the uniting groove 25, on the uniting groove 25 side, while on the engagement part 24 sides, the widths of the separating grooves 26 are the same as the outermost widths W2 of the harness engagement grooves 23*a*, 23*b*.

The antenna component 30 in this embodiment produces the same advantageous effects as the antenna component 20 according to the first mode of embodiment. In addition, because the engagement part 24 is reinforced by the inclined wall 31, there is no risk of the thin engagement part 24 being deformed or broken, when the harnesses are fitted into the harness engagement grooves 23*a*, 23*b*.

In the foregoing modes of embodiment of the present invention, cases were described in which the electronic component was a switch, but this may also be any other sort of electrical component such as, for example, a sensor, such as a capacitive sensor.

What is claimed is:

1. An rod-shaped antenna component comprising:

an elongate antenna body having longitudinal end portions and a resin cover on an outer surface, wherein engagement parts are formed in the resin cover and positioned on a single side of the antenna body, each engagement part being positioned at one longitudinal end portion and having at least two harness engagement grooves, and wherein a uniting groove is formed in the resin cover midway in said longitudinal direction on the single side thereof, said uniting groove extending longitudinally of said body and disposed intermediate of said engagement parts, said uniting groove having a transverse outermost width which is less than the transverse outermost width of said engagement grooves and said uniting groove being separated from said engagement parts at both of said longitudinal end portions.

2. The antenna component as recited in claim 1, further comprising separating grooves formed in said resin cover between said engagement parts at both of said longitudinal end portions and said uniting groove, the separating grooves for separating said engagement parts from said uniting groove.

3. An rod-shaped antenna device comprising:

an elongate antenna body having longitudinal end portions and a resin cover on an outer surface, wherein engagement parts are formed in the resin cover and positioned on a single side of the antenna body, each engagement part being positioned at one longitudinal end portion and having at least two harness engagement grooves, and wherein a uniting groove is formed in the resin cover midway in said longitudinal direction on the single side thereof, said uniting groove extending longitudinally of said body and disposed intermediate of said engagement parts, said uniting groove having a transverse outermost width which is less than the transverse outermost width of said engagement grooves and said uniting groove being separated from said engagement parts at both of said longitudinal end portions and an electrical component having at least two electrical harnesses, said harnesses being disposed in said engagement grooves and in said uniting groove.

4. The antenna device as recited in claim 3, wherein said harness engagement grooves and said uniting groove are spaced from one another.

5. The antenna device as recited in claim 3, wherein said electrical component is a request switch.

6. The antenna component as recited in claim 3, further comprising separating grooves formed in said resin cover between said engagement parts at both of said longitudinal end portions and said uniting groove, the separating grooves for separating said engagement parts from said uniting groove.

7. A rod-shaped antenna, comprising:

an elongate antenna body having longitudinal end portions and a resin cover on an outer surface, wherein, at the first end portion is formed in the resin cover a first engagement structure having at least two first harness engagement grooves disposed transversely relative to a longitudinal length of the elongate body;

wherein at the second end portion is formed in the resin cover a second engagement structure having at least two second harness engagement grooves disposed transversely relative to the longitudinal length of the elongate body; and wherein intermediate of the first structure and second structure is formed in the resin cover a longitudinally extending uniting groove of the elongate body having a transverse width that is less than a transverse combined width of said at least two first harness engagement grooves, and that is less than a transverse combined width of said at least two second harness engagement grooves and that is separated from said first and second structures.

8. The antenna of claim 7, wherein longitudinally extending walls of the elongate body define the longitudinally extending groove, each one of said walls having a thickness delimited by an inner longitudinally extending surface and an outer longitudinally extending surface, the outer longitudinally extending surfaces of said walls being separated by a width that defines the width of the elongate body.

9. The antenna of claim 7, wherein longitudinally extending walls of the elongate body define the longitudinally extending groove, the longitudinally extending groove occurring at an upper face of the elongate body, and wherein said first engagement structure and said second engagement structure are longitudinally spaced from an uppermost surface of said longitudinally extending walls.

10. The antenna of claim 7, in combination with an electrical component having at least two electrical harnesses, said harnesses being disposed respectively in said at least two first harness engagement grooves of said first structure, in corresponding ones of said at least two second harness engagement grooves of said second structure, and in said longitudinally extending groove between said first engagement structure and second engagement structure.

11. The antenna in combination with the electrical component according to claim 10, wherein said electrical component is a request switch.

12. The antenna component as recited in claim 7, further comprising separating grooves formed in said resin cover between said engagement structures at both of said longitudinal end portions and said uniting groove, the separating grooves for separating said engagement structures from said uniting groove.

* * * * *